United States Patent [19]

Menegatto

[11] Patent Number: 4,739,941

[45] Date of Patent: Apr. 26, 1988

[54] CENTRIFUGAL SPOOL-CLAMPING DEVICE

[76] Inventor: Carlo Menegatto, Via E. Spreafico N 3, 20052 Monza, Milano, Italy

[21] Appl. No.: 37,057

[22] Filed: Apr. 13, 1987

Related U.S. Application Data

[63] Continuation of Ser. No. 817,534, Jan. 6, 1986, abandoned.

[30] Foreign Application Priority Data

May 14, 1985 [IT] Italy ..... 20689 A/85

[51] Int. Cl.[4] ..... B65H 54/54

[52] U.S. Cl. ..... 242/46.5

[58] Field of Search ..... 242/46.5, 46.2, 46.3, 242/46.4, 46.6, 68.2, 72; 57/129, 130; 279/1 C, 1 Q

[56] References Cited

U.S. PATENT DOCUMENTS

| | | | |
|---|---|---|---|
| 2,136,073 | 11/1938 | Cooper | 242/46.5 |
| 2,697,561 | 12/1954 | Curtis | 242/46.5 |
| 2,755,027 | 7/1956 | Jones et al. | 242/46.5 |
| 3,048,002 | 8/1962 | Jost | 242/46.5 X |
| 3,250,479 | 5/1966 | McPherson | 242/46.5 |
| 3,302,384 | 2/1967 | Smith et al. | 242/46.5 X |
| 3,927,515 | 12/1975 | Northup et al. . | |

FOREIGN PATENT DOCUMENTS

| | | |
|---|---|---|
| 0078978 | 5/1983 | European Pat. Off. . |
| 550108 | 5/1932 | Fed. Rep. of Germany . |

*Primary Examiner*—Stanley N. Gilreath

*Attorney, Agent, or Firm*—Cushman, Darby & Cushman

[57] ABSTRACT

The invention refers to a centrifugal device for clamping spools on the spindles of textile machines. The clamping device substantially comprises an annular element of elastomeric material fitted on the spindle, comprising a cylindrical shank portion and an outwardly diverging conical disk portion which, when subjected to centrifugal forces created by the rotation of the spindle, will bend inwardly coming into contact and sliding with a certain amount of friction, against the internal surface of the spool, causing an axial thrust on the spool, towards a stop shoulder.

6 Claims, 2 Drawing Sheets

CENTRIFUGAL SPOOL-CLAMPING DEVICE

This is a continuation of application Ser. No. 817,534, filed Jan. 6, 1986, now abandoned.

BACKGROUND OF THE INVENTION

This invention refers to a centrifugal device for clamping spools on rapidly rotating spindles, and in particular to a clamping device which can be applied to the spindles of textile machines. Spools are currently clamped onto the spindles of textile machines by means of mechanical locking systems which include the use of manually operated plugs engaging and disengaging the spool and the spindle itself. The manual operation of fitting and removing the locking plug is a lengthy and dangerous operation to carry out, in that it must be carried out with the spindle completely stationary; moreover, with this system, it is not possible to doff the spools automatically.

The European published patent application No. 0078978 refers to a spoolholder operated by fluid under pressure, which makes use of at least two elastomeric spool clamping elements, arranged along a spindle; each clamping element comprises an annular shank portion and a conical disk portion having a cylindrical outer edge which is axially compressed by fluid actuated urging means surrounding the disk portion in order to expand it, causing the cylindrical edge surface of the conical portion to radially press and adhere to the inner surface of the spool, holding the latter on the rotating spindle.

This known clamping device has been proposed in place of expansible metal disk-like clamping devices which could damage the spools. Even though it is possible to automatically lock the spools, with the device according to European published patent application No. 0078978, it nevertheless suffers from numerous drawbacks which make it rather unsuitable for use on spindles which are made to rotate at very high speed, over 15,000/20,000 revolutions a minute, or for clamping very heavy spools. In particular, in the clamping device according to the above European patent application, the internal surface of the spool is subjected merely to radial clamping forces, due to the simple axial compression of the outer edge of the conical disk portion. Consequently, if the axial compression of the conical portion were to weaken or accidentally decrease, then the spool would no longer be securely clamped and could slide off the rapidly rotating spindle, due to axial components of the forces which could come into play. Moreover, the elastomeric retaining element is shaped in such a way as not to exclude the danger of it breaking and becoming detached from the spindle; for these reasons, it is desirable to prevent excessive radial expansion and bending of the conical disk portion of each elastomeric spool clamping element. This invention concerns a device for clamping spools on spindles which, unlike the conventional approaches, actually exploits the effect of the centrifugal force itself to clamp the spool onto a rapidly rotating spindle, exerting an axial thrust along the spool, which tends to hold the spool locked against a stop shoulder on the spindle.

A further scope of this invention is to provide a clamping device, as hereinbefore described, which makes use of elastomeric retaining elements which are specially designed to provide a clamping force which gradually increases with the number of revolutions of the spindle.

A further scope of the invention is to provide a clamping device which can easily be applied to any type of spindle whatsoever, which is extremely reliable, and not liable to accidentally break or come loose, in that it is provided with retaining means which prevent it from sliding axially off the spindle.

BRIEF DESCRIPTION OF THE DRAWINGS

These and further objects can be achieved with the centrifugal spool clamping device, as hereunder described and as claimed wherein:

DESCRIPTION OF THE INVENTION

Figure 1:
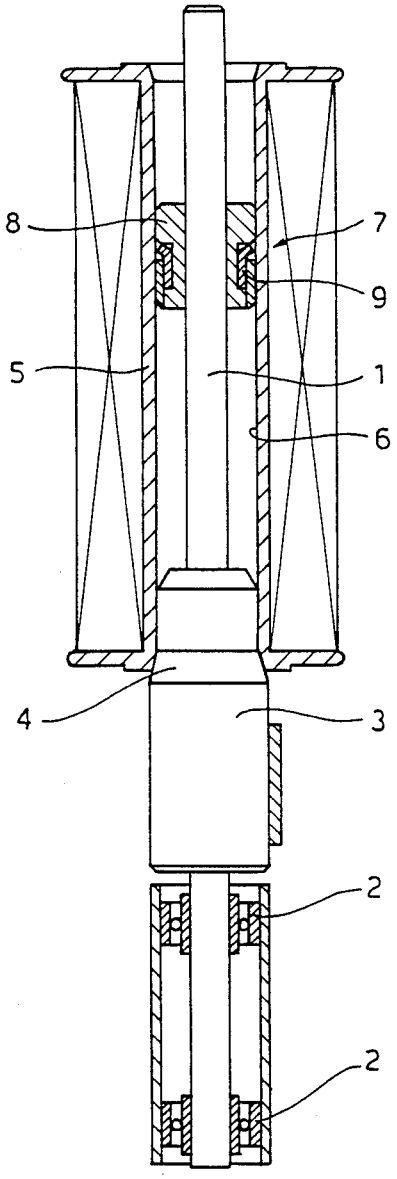
FIG. 1 shows a longitudinal cross-sectional view of a spindle provided with a centrifugal spool clamping device, according to this invention.

FIG. 1 shows a textile spindle comprising a rod 1 supported for rotation by means of bearings 2 at the lower end of the rod itself. The intermediate portion 3 of the spindle is larger in diameter and defines a belt-pulley ending in a conical shoulder 4 for centering and stopping a spool 5 onto which a quantity of yarn is to be wound. The spool 5 has an inner cylindrical surface 6 by which it is clamped onto the spindle 1 by means of the centrifugal clamping device according to the invention, which is generally indicated by reference 7.

According to one particular embodiment, the clamping device 7 comprises a reel or supporting member 8 secured in the appropriate position on the spindle 1; the reel member 8 comprises an upper cylindrical portion **8*a* having a larger diameter which is slightly smaller than the internal diameter of the spool 5, both in order to keep the spool 5 properly centered and arranged coaxial to the spindle 1 and an intermediate portion 8*b* of smaller diameter in order to define an annular seat 10 for a spool-clamping member 9** of elastomeric material such as natural or synthetic rubber or other plastic material.

Figure 3:
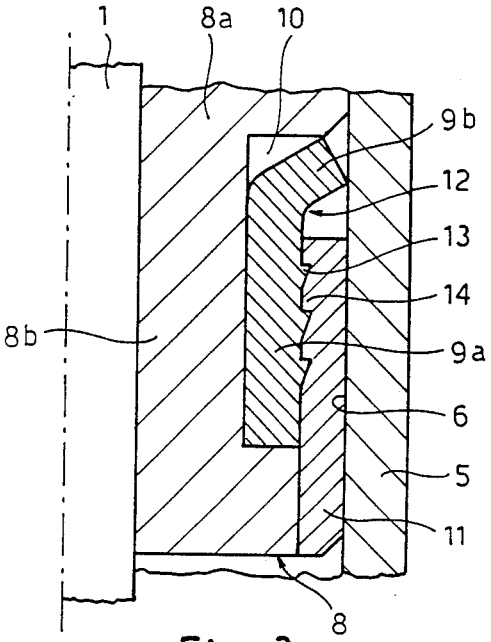
FIG. 3 shows an enlarged part section of FIG. 1, in the disengaged condition of the spool.
Figure 2:
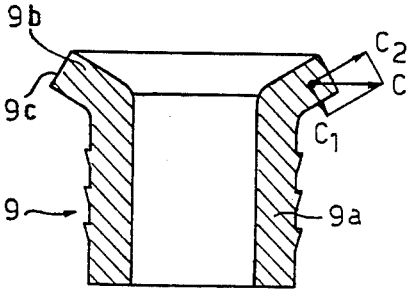
FIG. 2 shows an enlarged longitudinal cross-section of the elastomeric clamping member.
Figure 4:
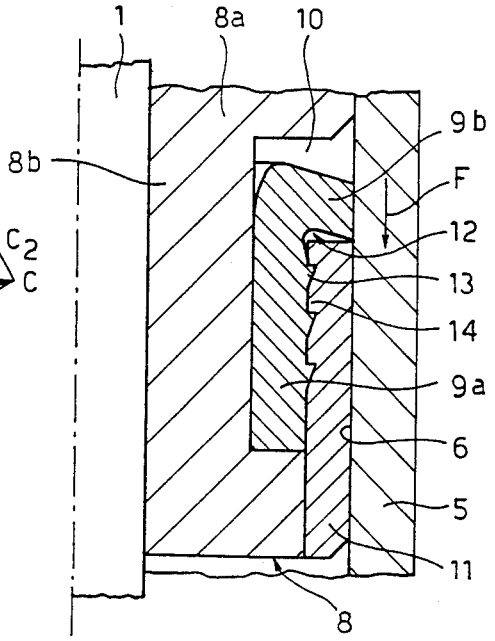
FIG. 4 shows a similar cross-section, in the clamped condition of the spool.

In particular, as shown in the other figures, the elastomeric clamping member 9, which serves to hold the spool 5 on the rapidly rotating spindle 1, comprises a cylindrical shank portion **9*a*, of considerable thickness, and an upper conical disk portion 9*b*, which diverges forwards, forming an angle, for example, ranging between 30° to 60° with the axis of the shank portion 9*a*. The conical portion 9*b* is substantially delimited by conical side surfaces, coaxially arranged and having the same diverging angle, however it is possible for the diverging angle of the side surfaces of the conical portion 9*a* to differ from each other. Consequently, unlike other known elastomeric elements, in which the forwardly diverging conical portion has an outer edge delimited by a cylindrical surface substantially coaxial to the axis of the spindle, to allow it to expand radially by compression, in the case of the present invention the conical portion 9*b* has an outer edge delimited by a substantially conical surface 9*c*, or rearwardly diverging, in the opposite direction to the conical disk portion 9*b*. As shown in FIG. 2, it is clear that when the elastomeric clamping element 9 is subjected to a rapid rotation by the spindle 1, centrifugal forces are created on the conical portion 9***b* which are evenly distributed along the peripheral edge and which can be resolved into component forces C1 downwardly oriented with respect to the conical disk portion 9*b* and force components C2 orthogonal to C1 or having the same inclination as said conical portion 9*b*. Consequently, under the effect of these centrifugal forces and, due to the fact that the conical portion 9*b* is freely movable in the seat 10 of the reel member 8, as explained further on, the conical portion 9*b* not only tends to be radially expanded by the forces C2, going on to press against the internal wall 6 of the spool 5, but is also bent downwards by the action of the component C1 of the centrifugal force, thrusting and keeping the spool 5 against the annular stop shoulder 4, with a frictional force F that depends solely upon the centrifugal force C. As the spindle picks up speed, the force F gradually increases, making the clamping member 9 change from the initial condition shown in FIG. 3, in which the outer edge 9*c* of the conical portion is flush with the wall 6 of the spool just with its lower corner, to the final condition shown in FIG. 4, in which the entire outer edge 9*c* has come into contact with the aforesaid internal surface 6, due to the bending downwards of the conical portion 9*b*, exerting rearwardly directed frictional forces F parallel to the axis of the spindle. As, in bending from the condition of FIG. 3 to that of FIG. 4, the conical portion 9*b* must undergo a resilient compression, and due to the slightest sloping disposition that it may assume with respect to a plane at right angles to the spindle, the conical disk portion 9*b* is thrust further against the spool 5, and the outer edge 9*c* of said conical disk portion adheres more closely to the internal surface 6 of the spool. As the number of revolutions of the spindle 1 and, therefore, of the clamping member 9 decrease, the resilient conical portion 9*b* will tend to rise, returning to the initial conditions shown in FIG. 3 in order to allow the disengagement and removal of the spool 5.

In order to allow the conical disk portion 9*b* only to bend freely under the action of the centrifugal forces and to prevent the clamping element 9 from breaking and/or becoming detached from the reel 8 under the effect of high centrifugal force, retaining means have been provided in the form of a cylindrical sleeve 11 externally surrounding the reel 8 and axially over the greatest part of the shank portion 9*a* of the clamping member 9, ending at a certain distance from the reel portion 8*a*, and beneath the conical portion 9*b* of the clamping member 9, for example, just ahead of the merging line 12 between the cylindrical shank portion 9*a* and the conical lip portion 9*b*, thereby defining an annular aperture, thus allowing the latter freedom to move or to bend downwards, when subjected to the centrifugal forces, as explained previously, without causing expansion of deformation of the cylindrical shank portion 9*a* of the elastomeric clamping member 9.

In order to ensure that the elastomeric clamping member 9 remains securely positioned in the seat 10, the outer surface of the cylindrical shank 9*a* may be provided with toothing 13, which engages with identical toothing 14 on the internal surface of the sleeve 11; the toothings may either be provided in pre-established areas or peripherally in the form of annular ribs.

The centrifugal clamping device according to this invention, can be used on any type of spindle whatsoever, to clamp one or more spools, irrespective of the orientation of the spindle itself. It is evident, however, that unlike the clamping devices known up till now, it permits quick and automatic replacement of the spools, even on slowly rotating spindles, since it does not require additional control devices, for which it would be necessary to bring the spindle to a complete standstill. Moreover, the clamping action of the device occurs elastically by friction, with both a radial and an axial thrust towards a shoulder for centering and positioning the spool on the spindle itself. This prevents damage to the spools wound with yarn, and ensures that the spools themselves do not accidentally slide off the spindle, due precisely to the axial thrust in the direction of the stop shoulder, thereby overcoming the drawbacks of heretofore known clamping devices. According to tests carried out, the clamping device of this invention not only has proved to be extremely reliable and efficient even at very high speeds of rotation of the spindles on textile machines currently in use, but has also proved to be extremely simple in structure and use and, therefore, inexpensive.

What is claimed is:

1. A centrifugal clamping device for clamping a spool on a rotating spindle, said spool having a cylindrical internal surface, said clamping device comprising:

a support member having a longitudinal axis and being rotatably coupled to the spindle, and spool clamping means coaxially mounted to and engaged with said support member, said support member comprising a cylindrical upper spool-guiding portion having an outer diameter substantially corresponding to but less than the diameter of the internal surface of the spool, and an intermediate portion defining an annular seat with a smaller diameter than said upper portion for supporting said spool clamping means, said spool clamping means having a thick-walled annular elastomeric spool-clamping element, said annular spool-clamping element having a cylindrical shank portion disposed in said annular seat and a conical disk portion diverging outwardly from said cylindrical shank portion and towards said upper guiding portion of the support member, retainer means for retaining said shank portion with said annular seat, said retainer means being spaced below said upper spool-guiding portion thereby defining an annular aperture therebetween, said conical disk portion of the spool-clamping means protruding through said annular aperture, said conical disk portion having an outer edge flush with the cylindrical internal surface of the spool, the conical disk portion of the annular clamping element being bendable and movable against the internal surface of the spool in a direction substantially opposite to the upper spool-guiding portion of the support member under the influence of centrifugal forces within the spool generated by rotation of the spindle.

2. A centrifugal clamping device according to claim 1, wherein the outer edge of the conical disk portion of said annular clamping element is delimited by a conical surface converging in the direction of said spool-guiding portion of the support member.

3. A clamping device as claimed in claim 1, in which said means for retaining the annular clamping element in the annular seat of said support member comprise an external sleeve surrounding the shank portion of the annular spool-clamping element.

4. A clamping device as claimed in claim 3, in which said retaining sleeve extends only along part of the length of the shank portion of the spoolclamping element.

5. A clamping device as claimed in claim 3, in which the shank portion of the spool-clamping element and the retaining sleeve are provided with toothings.

6. A clamping device as claimed in claim 5, in which said toothings are in the form of annular ribs.

* * * * *